US010720297B2

(12) United States Patent
Sun et al.

(10) Patent No.: US 10,720,297 B2
(45) Date of Patent: Jul. 21, 2020

(54) SUSPENDED GRID STRUCTURES FOR ELECTRODES IN VACUUM ELECTRONICS

(71) Applicant: Modern Electron, LLC, Bothell, WA (US)

(72) Inventors: Yong Sun, Belle Mead, NJ (US); Andrew T. Koch, Seattle, WA (US); Andrew R. Lingley, Seattle, WA (US); Chloe A. M. Fabien, Seattle, WA (US); Max N. Mankin, Seattle, WA (US); Tony S. Pan, Bellevue, WA (US)

(73) Assignee: Modern Electron, Inc., Bothell, WA (US)

( * ) Notice: Subject to any disclaimer, the term of this patent is extended or adjusted under 35 U.S.C. 154(b) by 0 days.

(21) Appl. No.: 16/514,361

(22) Filed: Jul. 17, 2019

(65) Prior Publication Data

US 2019/0341216 A1 Nov. 7, 2019

Related U.S. Application Data

(63) Continuation of application No. 16/041,643, filed on Jul. 20, 2018, now Pat. No. 10,424,455.

(60) Provisional application No. 62/535,826, filed on Jul. 22, 2017.

(51) Int. Cl.

| | |
|---|---|
| ***H01J 19/44*** | (2006.01) |
| ***H01J 9/18*** | (2006.01) |
| ***H01J 19/38*** | (2006.01) |
| ***H01J 1/46*** | (2006.01) |

(52) U.S. Cl.

CPC ..... *H01J 19/44* (2013.01); *H01J 1/46* (2013.01); *H01J 9/18* (2013.01); *H01J 19/38* (2013.01); *H01J 2209/012* (2013.01)

(58) Field of Classification Search

CPC .... H01J 19/44; H01J 9/18; H01J 19/38; H01J 1/46; H01J 2209/012

See application file for complete search history.

(56) References Cited

U.S. PATENT DOCUMENTS

| | | | | | |
|---|---|---|---|---|---|
| 2,624,100 | A ‡ | 1/1953 | Foulkes | ..... | H01J 19/38 140/71 R |
| 3,041,481 | A ‡ | 6/1962 | Peters, Jr. | ..... | H01J 45/00 310/30 |
| 3,154,711 | A ‡ | 10/1964 | Beggs | ..... | H01J 29/48 313/45 |
| 3,334,263 | A ‡ | 8/1967 | Beggs | ..... | H01J 19/00 313/250 |

(Continued)

FOREIGN PATENT DOCUMENTS

| | | | | |
|---|---|---|---|---|
| EP | 0971386 A2 | ‡ 1/2000 | ..... | H01J 1/304 |
| JP | 2257540 | ‡ 10/1990 | | |
| JP | 492345 | ‡ 3/1992 | | |

*Primary Examiner* — Donald L Raleigh

(74) *Attorney, Agent, or Firm* — Clements, Bernard, Walker, PLLC

(57) ABSTRACT

Disclosed embodiments include vacuum electronics devices and methods of fabricating a vacuum electronics device. In a non-limiting embodiment, a vacuum electronics device includes: an electrode; a first film layer disposed on the electrode about a periphery of the electrode; and a second film layer disposed on the first film layer, the second film layer including a plurality of electrically conductive grid lines patterned therein that are supported only at the periphery of the electrode by the first film layer.

30 Claims, 8 Drawing Sheets

(56) References Cited

U.S. PATENT DOCUMENTS 3,484,645 A ‡ 12/1969 Drees ..... H01J 19/00 313/34
3,755,704 A ‡ 8/1973 Spindt ..... H01J 1/3042 313/30
3,971,964 A ‡ 7/1976 Slosiar ..... H01J 9/14 313/355
4,471,267 A ‡ 9/1984 Amboss ..... H01J 23/065 313/34
4,528,474 A ‡ 7/1985 Kim ..... H01J 1/15 313/30
4,771,201 A ‡ 9/1988 Free ..... H02N 3/00 310/30
4,983,878 A ‡ 1/1991 Lee ..... H01J 1/3042 216/11
5,259,799 A ‡ 11/1993 Doan ..... H01J 9/025 445/24
5,382,185 A ‡ 1/1995 Gray ..... H01J 1/3042 216/11
5,430,347 A ‡ 7/1995 Kane ..... H01J 3/022 313/30
5,493,177 A ‡ 2/1996 Muller ..... G01J 3/108 313/57
5,548,185 A * 8/1996 Kumar ..... H01J 1/304 313/306
5,578,901 A ‡ 11/1996 Blanchet-Fincher ... H01J 1/304 313/49
5,686,782 A ‡ 11/1997 Hecker, Jr. ..... H01J 3/022 313/30
6,204,597 B1 ‡ 3/2001 Xie ..... H01J 3/022 313/30
6,987,027 B2 ‡ 1/2006 Jin ..... H01J 3/021 438/20
7,005,783 B2 ‡ 2/2006 Hwu ..... H01J 19/08 313/29
9,666,401 B2 ‡ 5/2017 Park ..... H01J 3/021
9,865,789 B2 ‡ 1/2018 Geballe ..... H01J 45/00
2002/0121857 A1 * 9/2002 Yonezawa ..... H01J 31/126 313/495
2002/0142523 A1 ‡ 10/2002 Ryu ..... H01L 21/28114 438/14
2003/0042841 A1 ‡ 3/2003 Ku ..... H01J 29/085 313/495
2003/0146681 A1 * 8/2003 Hwu ..... H01J 19/08 313/293
2003/0146689 A1 * 8/2003 Hwu ..... H01J 1/13 313/495
2004/0027053 A1 ‡ 2/2004 Amey, Jr. ..... H01J 9/14 313/49
2004/0104656 A1 ‡ 6/2004 Wilson ..... H01J 1/3044 313/30
2004/0145298 A1 * 7/2004 Seon ..... H01J 31/12 313/495
2005/0258514 A1 ‡ 11/2005 Smith ..... H01J 9/14 257/61
2005/0266766 A1 ‡ 12/2005 Wei ..... B82Y 10/00 445/50
2007/0235772 A1 * 10/2007 Jin ..... G09G 3/22 257/236
2008/0067912 A1 * 3/2008 Ishida ..... H01J 1/304 313/309
2011/0074274 A1 ‡ 3/2011 Tang ..... H01J 1/304 313/296
2012/0105758 A1 ‡ 5/2012 Qin ..... G02F 1/1309 349/42
2014/0137397 A1 * 5/2014 Wei ..... H04R 31/00 29/594
2014/0159566 A1 * 6/2014 Liu ..... H01J 1/304 313/346 R
2016/0141382 A1 * 5/2016 Mankin ..... H01L 21/02164 257/607
2016/0196948 A1 ‡ 7/2016 Kim ..... H01L 29/7613 136/25
2017/0263409 A1 ‡ 9/2017 Koch ..... H01J 9/02

* cited by examiner
‡ imported from a related application

SUSPENDED GRID STRUCTURES FOR ELECTRODES IN VACUUM ELECTRONICS

CROSS-REFERENCE TO RELATED APPLICATIONS

The present application is a continuation of U.S. patent application Ser. No. 16/041,643 filed Jul. 20, 2018, which is related to and claims the benefit of priority of the filing date of U.S. Provisional Patent Application No. 62/535,826 filed Jul. 22, 2017, both of which are herein incorporated by reference in their entirety.

TECHNICAL FIELD

The present disclosure relates to vacuum electronics devices.

BACKGROUND

Vacuum electronics devices include devices such as field emitter arrays, vacuum tubes, electric thrusters, gyrotrons, klystrons, travelling wave tubes, thermionic converters, and the like. In vacuum electronics devices, it may be beneficial to place a conductive grid (for example, a control grid, suppressor grid, screen grid, accelerator grid, focus grid, or the like) closely adjacent to an electrode (for example, a cathode or an anode). Such a grid may use a bias voltage to control and/or modulate the flow of charged particles in the vacuum electronics device.

Suspended grids separate the grids and electrodes by a vacuum gap. Unlike charge conduction in a solid, the electrons and ions travelling between the electrodes can travel ballistically through the emptiness of even an imperfect vacuum. The charges are accelerated by the suspended grids and can reach very high velocities with infrequent collisions. Furthermore, vacuum is the best medium to prevent electrical breakdown and can help to mitigate dielectric material failure when a large voltage bias is applied between the grid and the electrodes. Conventionally, a suspended grid is fabricated separately from the electrode. An example of a suspended grid is a triode vacuum tube. See U.S. Pat. No. 1,630,443.

SUMMARY

Disclosed embodiments include vacuum electronics devices and methods of fabricating a vacuum electronics device.

In a non-limiting embodiment, a vacuum electronics device includes: an electrode; a first film layer disposed on the electrode about a periphery of the electrode; and a second film layer disposed on the first film layer, the second film layer including a plurality of electrically conductive grid lines patterned therein that are supported only at the periphery of the electrode by the first film layer.

In another non-limiting embodiment, a method of fabricating a vacuum electronics device includes: providing an electrically conductive substrate; depositing a first film layer on the substrate; depositing a second film layer on the first film layer; defining a plurality of grid lines in the second layer; and selectively removing a portion of the first film layer such that the first film layer supports the plurality of grid lines only at a periphery of the substrate.

In another non-limiting embodiment, a method of fabricating a vacuum electronics device includes: coating a stack of an electrode and a first film layer disposed on the electrode with resist; exposing the resist; developing the resist; etching the first film layer; removing the resist; and depositing the second film layer.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the text (e.g., claims and/or detailed description) and/or drawings of the present disclosure.

BRIEF DESCRIPTION OF THE FIGURES

Illustrative embodiments are illustrated in referenced figures of the drawings. It is intended that the embodiments and figures disclosed herein are to be considered illustrative rather than restrictive.

DETAILED DESCRIPTION

Figure 1A:
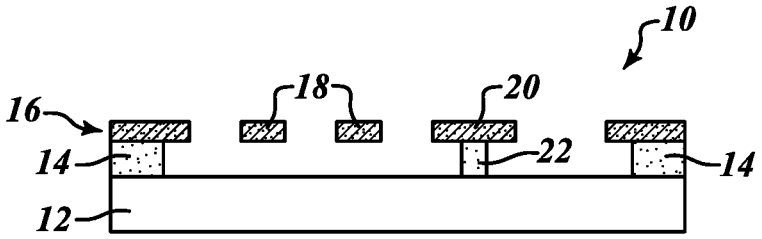
FIG. 1A is a cross-sectional end plan view in partial schematic form of an illustrative tunable suspended grid structure.

In the following detailed description, reference is made to the accompanying drawings, which form a part hereof. In the drawings, the use of the same symbols in different drawings typically indicates similar or identical items unless context dictates otherwise. The illustrative embodiments described in the detailed description, drawings, and claims are not meant to be limiting. Other embodiments may be utilized, and other changes may be made, without departing from the spirit or scope of the subject matter presented here.

Given by way of overview, various disclosed embodiments provide a suspended grid that is fabricated along with the electrode. Still by way of overview, various embodiments pattern a multilayer film (such as a top film of a multilayer film stack) and selectively etch away or undercut the film and, in some embodiments, the substrate underneath (such as the bottom film of a multilayer film stack or the substrate underneath the film stack). In these embodiments, material in the film layer underneath under the film layer that forms the grid lines may be etched away completely (except for supporting material at the ends of the grid lines), thereby creating suspended grid lines.

Such suspended structures may help to improve the voltage breakdown strength of vacuum electronics by separating the grid lines and the electrodes with a vacuum gap. During operation, because of the vacuum gap the suspended grid may be able to sustain a higher voltage bias (compared to conventional grids that are supported by a layer of dielectric material) without catastrophic material failure when a voltage bias is applied between the suspended grid and the electrode. This is because some embodiments of devices disclosed herein include suspended grid lines that are supported only by material (deposited on the electrode) at ends of the grid lines. Such embodiments can help improve electrical breakdown strength of the grid structure, thereby helping reduce likelihood of a typical grid failure mechanism of dielectric material breakdown under high voltage bias.

Such suspended structures may also help to allow the grid/electrodes gap in some embodiments to be extremely small yet tunable (such as by electrostatic force applied between the grid and electrodes to fine tune the vacuum gap), thereby helping to permit increasing the electric field strength by decreasing the gap distance between the suspended grid and the electrode instead of the conventional method of simply increasing grid voltage. It will be appreciated that a tunable vacuum gap between the grid and the electrodes may be desirable in certain applications of vacuum electronics, for example without limitation in field emission- or electric field induced-tunneling, where increasing the electric field at low grid voltages can help increase device efficiency and reliability.

It will be appreciated that nano-scale devices and their fabrication processes may have an inherent nexus. For example, the choice of materials and fabrication steps for a device may take part in helping to define the device—just as the reverse may occur. It will also be appreciated that some of these choices may be brought about by issues regarding fabrication compatibility (for example and without limitation, using a doped semiconductor versus using a metal for a certain film).

It will be appreciated that disclosed embodiments are applicable to use of a grid that is closely separated from an electrode and supported only at the periphery of the electrode on any of the dielectric support structures disclosed herein or made by fabrication processes disclosed herein for vacuum electronics applications, including without limitation: thermionic devices, amplifiers, travelling wave tubes, klystrons, triodes, diodes, tetrodes, pentodes, mass spectrometers, residual gas analyzers, ion pumps, electron or ion or charged particle beam systems (such as electron microscopes, ion beams for milling, and the like), electrostatic or electromagnetic lenses, and other vacuum devices. It will also be appreciated that dielectric geometry may help to minimize surface and bulk dielectric leakage current and maximize dielectric breakdown strength between the grid and the electrode, so that different potentials may be applied to each.

Now that a non-limiting overview has been provided, illustrative details will be set forth below by way of non-limiting examples and not of limitation.

Figure 1B:
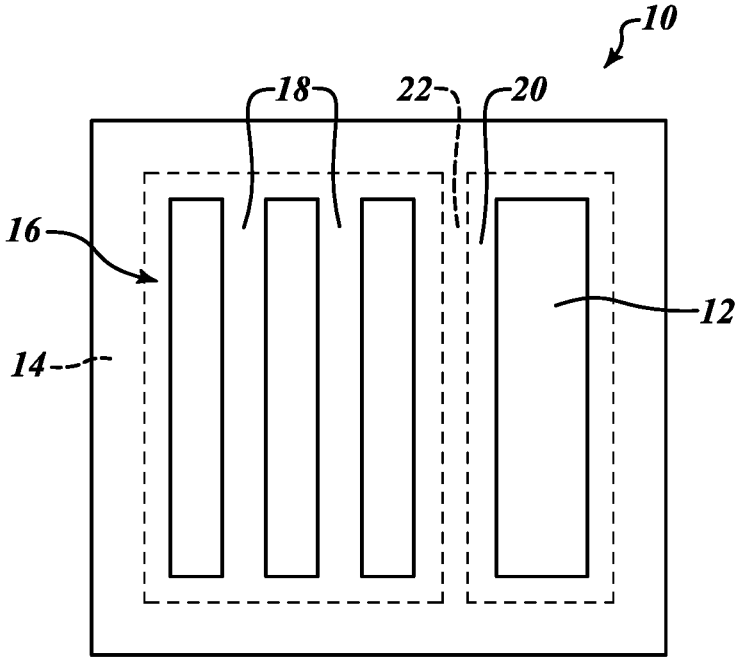
FIG. 1B is a top plan view of the tunable suspended grid structure of FIG. 1A.

Referring to FIGS. 1A and 1B, in various embodiments an illustrative vacuum electronics device 10 includes an electrode 12. A first film layer 14 is disposed on the electrode 12 about a periphery of the electrode 12. A second film layer 16 is disposed on the first film layer 14. The second film layer 16 includes electrically conductive grid lines 18 patterned therein that are supported only at the periphery of the electrode 12 by the first film layer 14. As such, it will be appreciated that in various embodiments the suspended grid lines 18 are fabricated along with—not separately from—the electrode 12.

It will be appreciated that, as shown in FIGS. 1A and 1B, in some embodiments, if desired, optional grid lines 20 may be patterned in the second film layer 16 and supported on supports 22 defined in the first film layer 14 as desired for a particular application. It is emphasized that such grid lines 20 and supports 22 are not required and are optional. It is also emphasized that required inclusion of the grid lines 20 and the supports 22 is not intended and is not to be inferred. To that end, various embodiments do not include the grid lines 20 and the supports 22.

In various embodiments, the electrode 12 may be provided as an electrically conductive substrate which may include, by way of non-limiting examples, chromium, platinum, nickel, tungsten, molybdenum, niobium, tantalum, or other appropriate metals. In various embodiments the electrode 12 may be an anode in a vacuum electronics device, as desired for a particular application. It will be appreciated that a larger opening (shown to the right in FIG. 1B) through the first film layer 14 may be provided, if desired, as an optional feature for electrically accessing the electrode 12 from the top.

In various embodiments the first film layer 14 may include a dielectric, an electrical insulator, a ceramic, silicon oxide, silicon nitride, and and/or aluminum oxide. In various embodiments, the second film layer 16 may include an electrical conductor, such as without limitation, chromium, platinum, nickel, tungsten, molybdenum, niobium, tantalum, or other appropriate metals. In some such embodiments, the electrical conductor may be disposed within an electrical insulator.

Still referring to FIGS. 1A and 1B, in various embodiments the second film layer 16 is partially supported by the first film layer 14 at the periphery of the electrode 12 and the grid lines 18 patterned in the second film layer 16 are suspended over the electrode 12. For purposes of clarity, only two grid lines 18 are shown in FIGS. 1A and 1B. In this non-limiting embodiment, a film stack is initially deposited on top of the electrode 12. The stack is patterned and can be etched. One or more grids sits atop the stack, and could be suspended over the electrode 12. In the non-limiting example shown in FIG. 1A, the first film layer 14 helps support part of the second film layer 16 (specifically, the ends of the grid lines 18), such that a majority of the grid lines 18 can be suspended over the electrode 12.

In some embodiments, the grid lines 18 (and, when optionally provided as desired, the optional grid lines 20) may include a geometry such as, without limitation, a substantially straight line, a curved line, a circle array, a triangle array, and/or a hexagon array. In some of these embodiments, the grid lines 18 and, when optionally provided as desired, the optional grid lines 20 may have the same shape or geometry. However, the grid lines 18 (and, when optionally provided as desired, the optional grid lines 20) need not have the same shape or geometry. To that end, in some other embodiments the grid lines 18 (and, when optionally provided as desired, the optional grid lines 20) have different shapes or geometries.

Regardless of geometry, it will be appreciated that the non-limiting embodiment of FIGS. 1A and 1B can support an electric field without causing electrical breakdown. As such, it will be appreciated that the non-limiting embodiment of FIGS. 1A and 1B may entail a gap between the grid lines 18 (and, when optionally provided as desired, the optional grid lines 20) and the electrode 12 on the order of around a few hundred nanometers to a few micrometers or so. In some embodiments, if desired, gap distance between the electrode 12 and portions of the grid lines 18 that are not supported by the first film layer 14 are variable responsive to application of an electrostatic force between the electrode 12 and the grid lines 18. The electrostatic force may be applied to the grid electrodes (that is, the grid lines 18) as part of the normal biasing of the grid electrodes with DC voltages or by modulating the normal electrode DC bias with an additional driving voltage to cause movement in the suspended grid lines 18. By way of example only, amplitude modulation can be used to adjust electrostatic forces to control fine motion.

Referring additionally to FIGS. 2A, 2B, 3A, 3B, 4A-4D, 5A, and 5B, it will be appreciated that various embodiments may entail various configurations as desired for various applications.

While FIGS. 1A, 1B, 2A, 2B, 3A, 3B, 4D, 5A, and 5B show only two suspended grid lines 18 for purposes of clarity, it will be appreciated that any number of grid lines 18 may be provided as desired for a particular application.

It will also be appreciated that, as shown in 2A, 2B, 3A, 3B, 4A-4D, 5A, and 5B, in some embodiments, if desired, the optional grid lines 20 may be patterned in the second film layer 16 and supported on the supports 22 defined in the first film layer 14 as desired for a particular application. It is emphasized again that such grid lines 20 and supports 22 are not required and are optional. It is also emphasized again that required inclusion of the grid lines 20 and the supports 22 is not intended and is not to be inferred. To that end, various embodiments do not include the grid lines 20 and the supports 22.

Figure 2A:
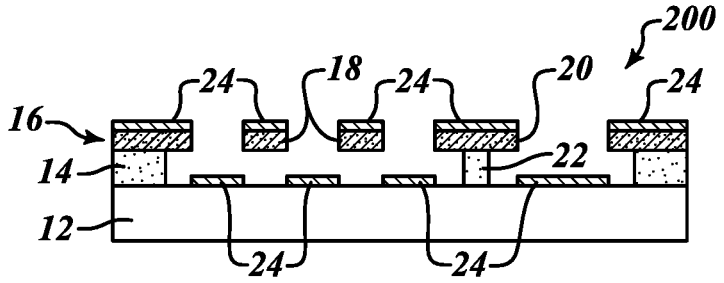
FIG. 2A is a cross-sectional end plan view in partial schematic form of another illustrative tunable suspended grid structure.
Figure 2B:
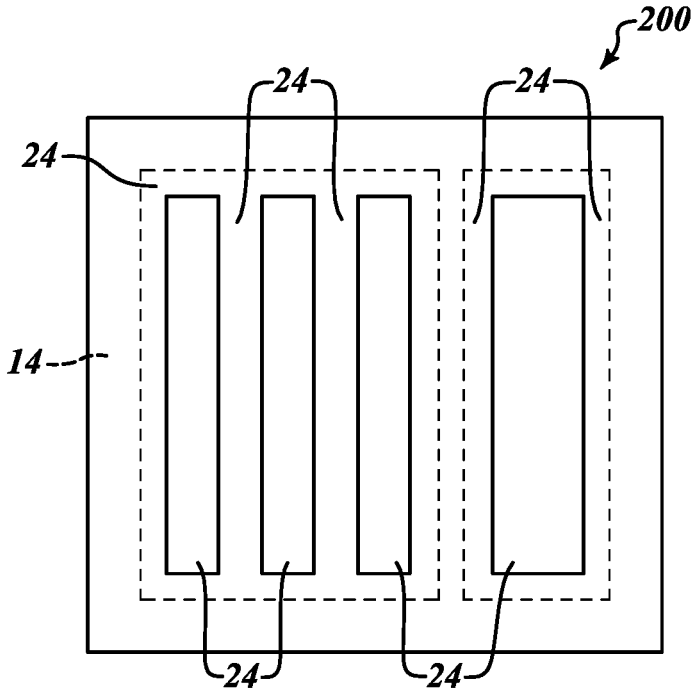
FIG. 2B is a top plan view of the tunable suspended grid structure of FIG. 2A.

Given by way of non-limiting example and as shown in FIGS. 2A and 2B, in various embodiments a vacuum electronics device 200 includes the electrode 12. The first film layer 14 is disposed on the electrode 12 about a periphery of the electrode 12. The second film layer 16 is disposed on the first film layer 14. The second film layer 16 includes electrically conductive grid lines 18 patterned therein that are supported only at the periphery of the electrode 12 by the first film layer 14. A layer of electrically conductive material 24 is disposed on the grid lines 18. In some such embodiments, a layer of the electrically conductive material 24 may be disposed on the electrode 12. In some embodiments, a layer of the electrically conductive material 24 may be disposed on the optional grid lines 20 (when optionally provided as desired).

In various embodiments, the conductive material 24 may include chromium, platinum, and/or the like, and the first film layer 14 may include silicon dioxide. In various embodiments, the second film layer 16 may include low-stressed material, such as without limitation silicon nitride, thereby helping to reduce associated stresses such that probability of cracking may be reduced when materials may be suspended from the second film layer 16. In some such embodiments, the conductive material 24 may serve as the conductive grid.

It will be appreciated that in some embodiments the electrically conductive material 24 disposed on the electrode 12 may be considered an artifact of deposition of the electrically conductive material 24 on the grid lines 18 (and, when optionally provided as desired, the optional grid lines 20). However, the electrically conductive material 24 disposed on the electrode 12 may help prevent particle bombardment. Also, the electrically conductive material 24 disposed on the electrode 12 may help reduce the gap between the grid and the electrode 12, thereby helping to increase the electric field and, accordingly, helping to enable quantum tunneling and helping to increase efficiency. It will be further appreciated that the conductive material 24 may be evaporated on top after the grid lines 18 have been suspended. It will be appreciated that the vacuum electronics device 200 may be suited for use in a field emission heat engine (which entails quantum tunneling).

Figure 3A:
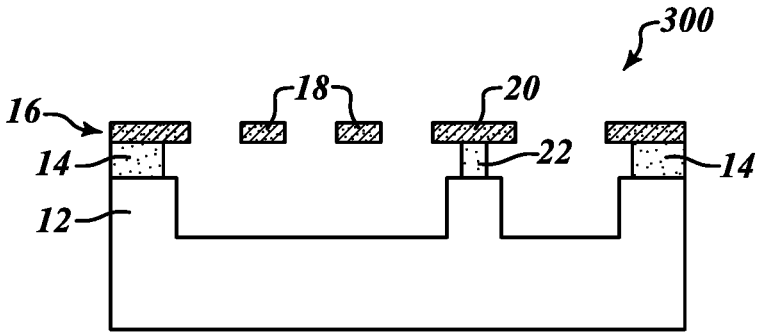
FIG. 3A is a cross-sectional end plan view in partial schematic form of another illustrative tunable suspended grid structure.
Figure 3B:
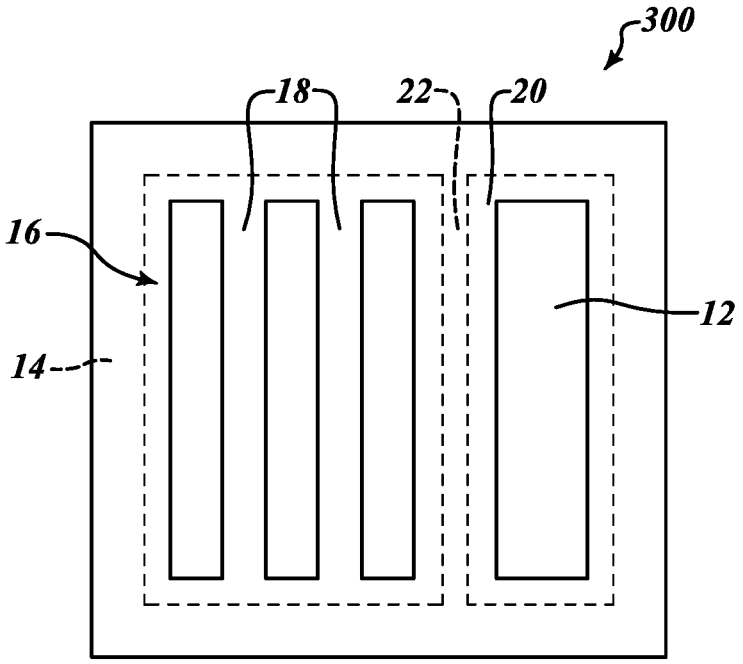
FIG. 3B is a top plan view of the tunable suspended grid structure of FIG. 3A.

Given by way of non-limiting example and as shown in FIGS. 3A and 3B, various embodiments a vacuum electronics device 300 may have a grid structure that is further separated from the electrode 12 than are typical grid structures. In such embodiments, the vacuum electronics device 300 includes the electrode 12. The first film layer 14 is disposed on the electrode 12 about a periphery of the electrode 12. The second film layer 16 is disposed on the first film layer 14. The second film layer 16 includes electrically conductive grid lines 18 patterned therein that are supported only at the periphery of the electrode 12 by the first film layer 14. In such embodiments, the substrate material underneath the first film layer 14 (that is, the electrode 12) can also be etched during the fabrication process. For instance, following the patterning of the first film layer 14 and the second film layer 16, the substrate underneath (that is, the electrode 12) can be further etched by wet or dry etching methods. As such, it will be appreciated that the vacuum electronics device 300 may have a grid structure that is separated further from the electrode 12 than are typical suspended grid structures. To that end, in various embodiments of the vacuum electronics device 300, the gap between the suspended grid lines 18 and the electrode 12 may be on the order of a few microns or tens of microns.

Various embodiments of the vacuum electronics device 300 may have a low fill factor (that is the ratio of area of the grid lines to the total area of the device) such as on the order of less than 2% or so. It will be appreciated that such a low fill factor can help to reduce grid loss (that is, electrons getting collected by the grid, thereby resulting in an IxV power loss) during operation. Moreover, because the grid lines 18 are moved further away from the electrode 12 than in a typical suspended grid structure, the grid lines 18 may be suspended across a longer distance than in a typical suspended grid structure. As a result, the suspended grid lines 18 may be stretched more than typical suspended grid lines without significantly increasing risk of shorting the suspended grid lines 18 to the electrode 12.

It will be appreciated that the vacuum electronics device 300 may be used in thermionic heat engines which do not entail quantum tunneling. Given by way of non-limiting example, the vacuum electronics device 300 may include a vacuum gap between the suspended grid lines 18 and the electrode 12 and may have an applied voltage bias. In such a case, it will be appreciated that the resulting electric field may be on the order of between 0.5 mV/nm-1 mV/nm.

Referring additionally to FIGS. 4A-4D, 5A, and 5B, in some embodiments a vacuum electronics device 400 may include a varied vacuum gap distance between the suspended grid lines 18 and the electrode 12. In some embodiments, the vacuum electronics device 400 includes the electrode 12. The first film layer 14 is disposed on the electrode 12 about a periphery of the electrode 12. The second film layer 16 is disposed on the first film layer 14. The second film layer 16 includes the electrically conductive grid lines 18 patterned therein that are supported only at the periphery of the electrode 12 by the first film layer 14, wherein a gap distance between the electrode 12 and the suspended grid lines 18 is varied.

Figure 4A:
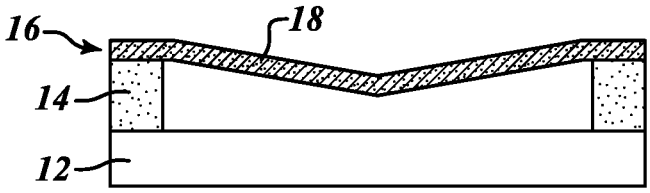
FIGS. 4A-4C are cross-sectional side plan views in partial schematic form of other illustrative tunable suspended grid structures.
Figure 4B:
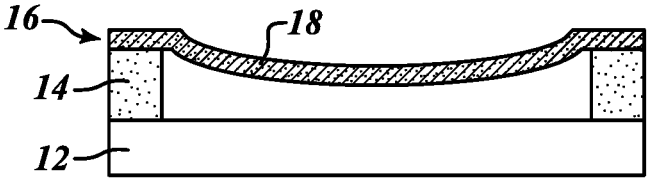
Figure 4C:
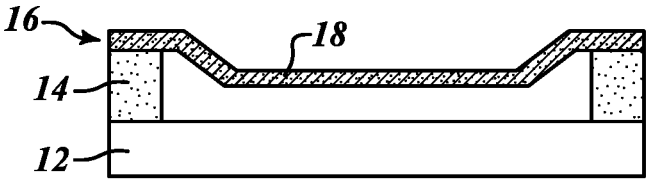
Figure 4D:
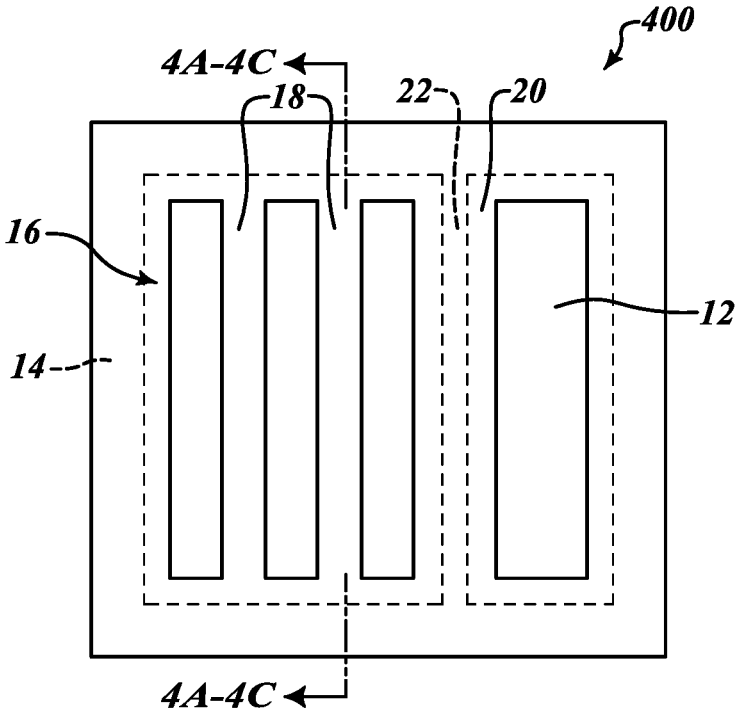
FIG. 4D is a top plan view of the tunable suspended grid structures of FIGS. 4A-4C.
Figure 5A:
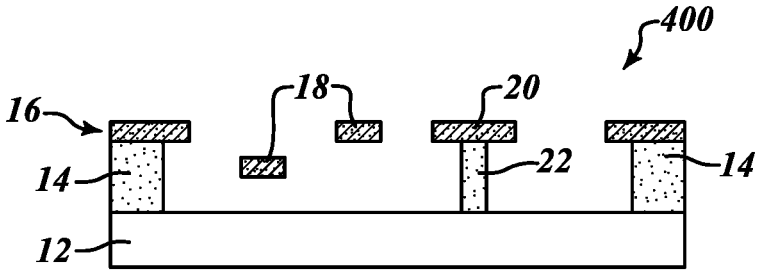
FIG. 5A is a cross-sectional end plan view in partial schematic form of another illustrative tunable suspended grid structure.
Figure 5B:
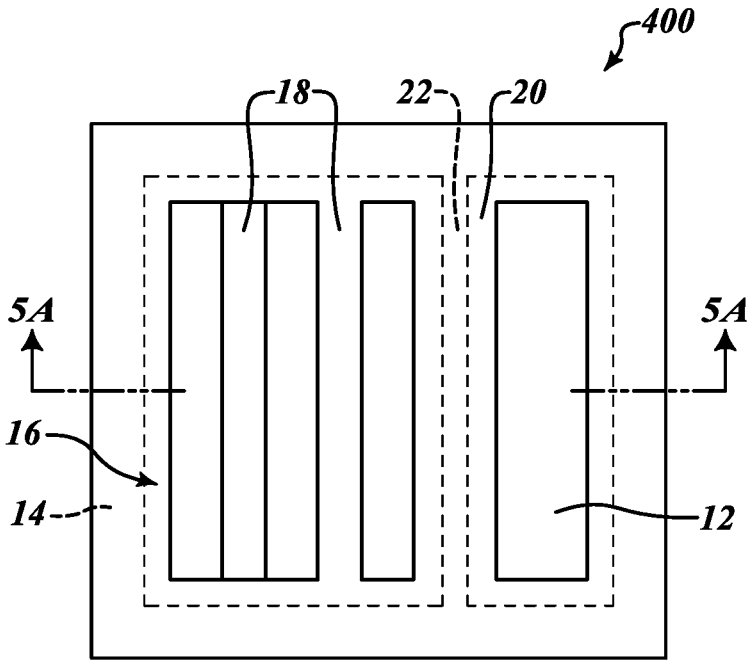
FIG. 5B is a top plan view of the tunable suspended grid structure of FIG. 5A.

It will be appreciated that varying the distance of the vacuum gap between the suspended grid lines 18 and the electrode 12 can vary and, in some cases to help optimize, the electric field between the grid and the electrode 12. It will also be appreciated that the shapes of the suspended grid lines 18 shown in FIGS. 4A-4C are given by way of illustration only and not of limitation. To that end, it will be appreciated that the suspended grid lines 18 may have any shape as desired for a particular application. Moreover, it will be appreciated that, as shown in FIG. 5A, different ones of the suspended grid lines 18 may have different vacuum gap distances as desired for a particular application.

Illustrative fabrication techniques for fabrication various embodiments of vacuum electronics devices are discussed below by way of non-limiting examples.

Referring additionally to FIGS. 6A-6F, an illustrative method of fabricating a vacuum electronics device includes: providing an electrically conductive substrate; depositing a first film layer on the substrate; depositing a second film layer on the first film layer; defining a plurality of grid lines in the second layer; and selectively removing a portion of the first film layer such that the first film layer supports the plurality of grid lines only at a periphery of the substrate.

In some embodiments, the method may also include depositing at least one electrically conductive film layer on the plurality of grid lines. In some such embodiments, depositing at least one electrically conductive film layer on the plurality of grid lines may also include depositing at least one electrically conductive film layer on the substrate.

In various embodiments depositing a first film layer on the substrate and depositing a second film layer on the first film layer may be performed via a process such as chemical vapor deposition, physical vapor deposition, evaporation, sputtering, electroplating, or atomic layer deposition.

In some embodiments, defining a plurality of grid lines in the second layer may include: patterning the second film layer; and etching the second film layer and the first film layer. In some such embodiments, patterning the second film layer may be performed via a process such as lithography, photolithography, electron-beam lithography, block co-polymer lithography, nanosphere lithography, nanoimprint lithography, self-aligned double patterning, or double patterning. In some such embodiments, etching the second film layer and the first film layer may be performed via a process such as wet etching, dry etching, plasma etching, ion bombardment, reactive-ion etching, isotropic etching, and anisotropic etching.

In some embodiments, selectively removing a portion of the first film layer underlying the plurality of third features may include selectively etching the first film layer.

In some embodiments, the method may also include selectively etching at least one of the first film layer and the second film layer to a geometry chosen from a substantially straight line, a curved line, a circle array, a triangle array, and a hexagon array.

Figure 6A:
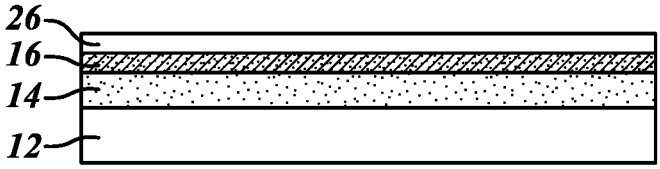
FIGS. 6A-6F illustrate steps in a method of fabricating the device of FIG. 1A.

In a non-limiting example given by way of illustration only, an illustrative method may be used to fabricate the vacuum electronics device 10. Such an illustrative method includes the following process steps:

As shown in FIG. 6A, the substrate 12 is spin coated with an image resist 26.

Figure 6B:
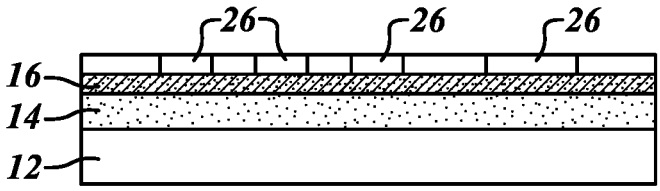

As shown in FIG. 6B, a sacrificial pattern is disposed on top of the second film layer 16 through standard lithography or exposure methods (for example, electron beam lithography, optical lithography, or imprinting lithography, block copolymer lithography, or the like).

Figure 6C:
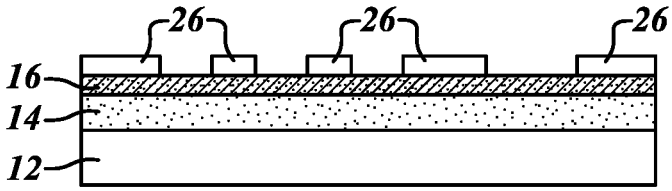

As shown in FIG. 6C, the resist 26 is used as a masking layer.

Figure 6D:
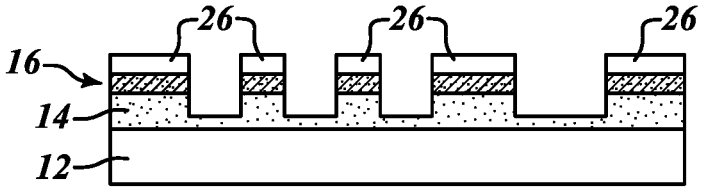

As shown in FIG. 6D, a selective etch into the second film layer 16 is performed to transfer the sacrificial pattern, and etching in the first film layer 14 is stopped at a predetermined point. As discussed above, the process may over-etch into the electrode 12 as desired for a particular application (See FIG. 3A).

Figure 6E:
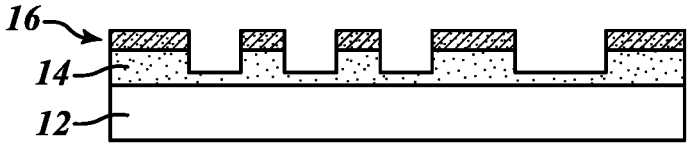

As shown in FIG. 6E, the resist is removed.

Figure 6F:
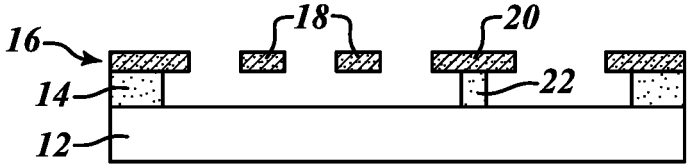
Figure 7A:
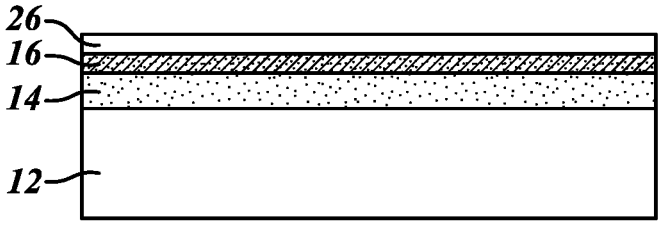
FIGS. 7A-7F illustrate steps in a method of fabricating the device of FIG. 3A.
Figure 7B:
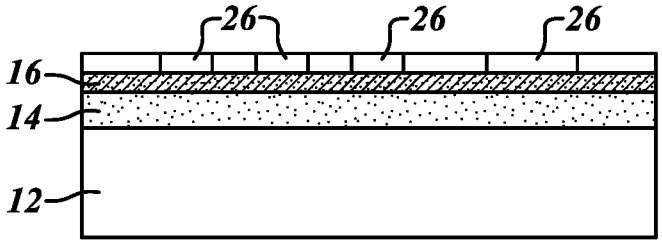
Figure 7C:
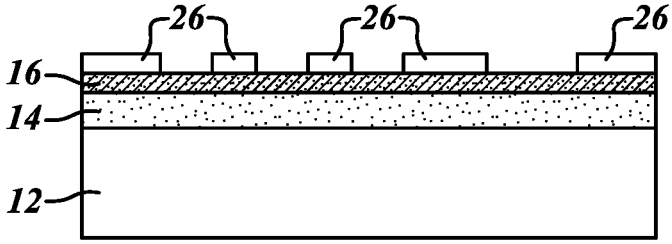
Figure 7D:
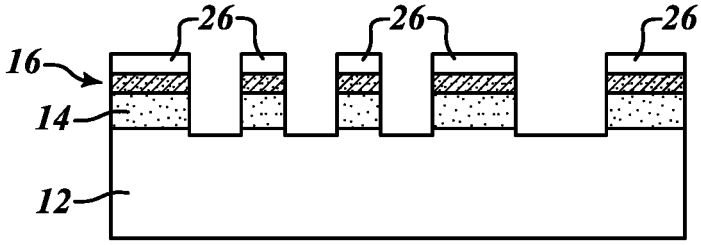
Figure 7E:
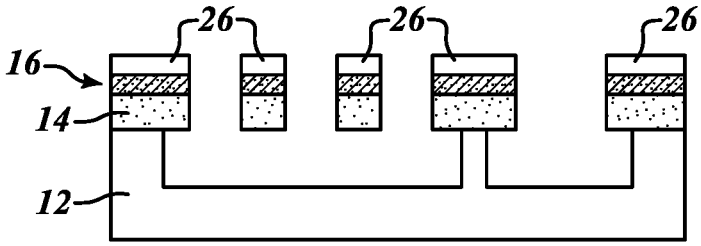
Figure 7F:
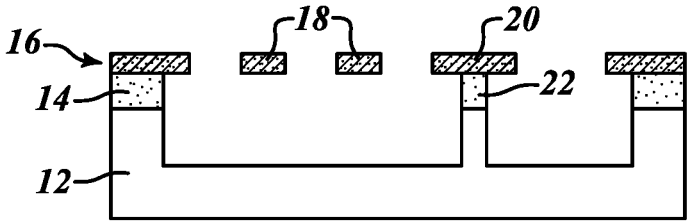

As shown in FIG. 6F, the first film layer 14 is selectively (that is, completely) undercut to suspend the pattern in the second film layer 16 (that is, the suspended grid lines 18). In some other embodiments, the first film layer 14 may be selectively (in this case, less-than-completely) undercut to pattern or define the supports 22 in the second film layer 16 for the optional grid lines 20, if desired. In some embodiments, a metal film (or a multi-layer metal film stack) 24 may be deposited on the already-suspended grid structure (not shown in FIGS. 6A-6F). See FIGS. 2A and 2B.

In an illustrative, non-limiting implementation of the process described above, a dielectric material such as a wet thermal oxide was used as the first film layer 14, a low-stressed dielectric material such as silicon nitride was used as the second film layer 16, and an i-line resist was used as the image resist 16. Exposure was carried out with an i-line stepper to create the grid pattern. The i-line resist was developed in a Tetramethylammonium Hydroxide (TMAH) developer. Etching of the first film layer 14 and the second film layer 16 was done with an Inductively Coupled Plasma Reactive Ion Etcher (ICP-RIE). Suspending the grid lines 18 was done in a wet chemical etch, which selectively etched the first film layer 14 without compromising the second film layer 16. Finally, in some embodiments a metal film 24 (FIGS. 2A and 2B) was deposited on top of the suspended low-stressed dielectric grid to make the grid lines 18 and, when optionally provided, the optional grid lines 20 conductive.

Referring additionally to FIGS. 7A-7F, a method may be used to fabricate the vacuum electronics device 300 with a grid structure that is further separated from the electrode 12 than are typical grid structures. Such an illustrative method includes: providing an electrically conductive substrate 12; depositing a first film layer 14 on the substrate; depositing a second film layer 16 on the first film layer 14; defining a plurality of grid lines 18 in the second film layer 16; selectively removing a portion of the first film layer 14 such that the first film layer 16 supports the plurality of grid lines 18 only at a periphery of the substrate 12; and selectively removing a portion of the substrate 12.

It will be appreciated that the fabrication process for the vacuum electronics device 300 is similar to the fabrication process for the vacuum electronics device 10, with an additional step to etch/undercut the material of the electrode 12. It will also be appreciated that, after the grid is suspended, a metal film or a multi-layer of metal film stacks 24 (not shown in FIGS. 7A-7F) may be deposited on the grid lines 18 and, when optionally provided, the optional grid lines 20.

Figure 8A:
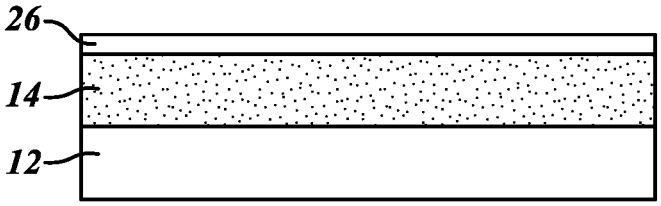
FIGS. 8A-8F illustrate steps in a method of fabricating the device of FIGS. 4A-4C.
Figure 8B:
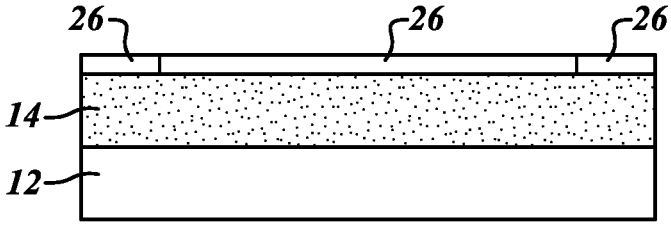
Figure 8C:
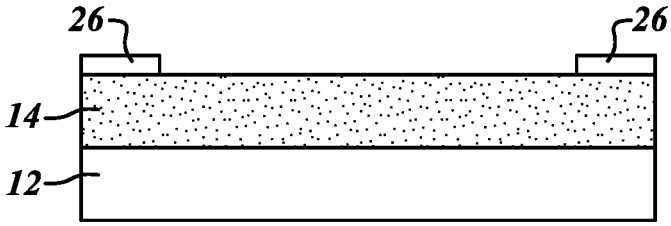
Figure 8D:
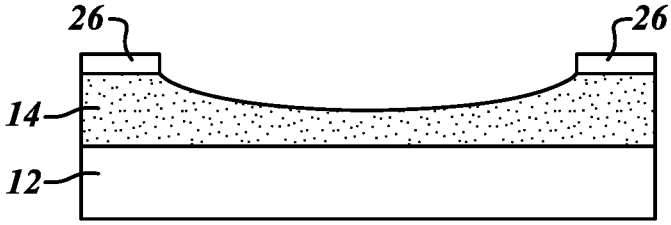
Figure 8E:
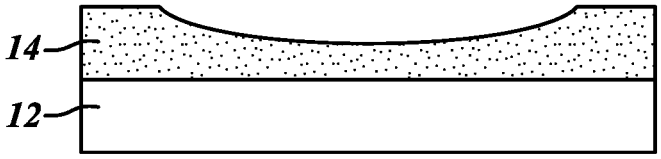
Figure 8F:
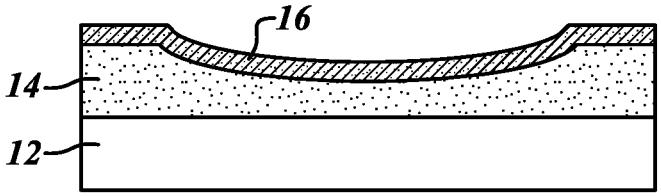

Referring additionally to FIGS. 8A-8F, a method may be used to fabricate the vacuum electronics device 400 with a varied vacuum gap distance between the suspended grid lines 18 and the electrode 12. It will be appreciated that an illustrative fabrication process of suspended patterns with varied gap distance involves patterning of the second film layer 16 to a specific shape (that is, before suspending the grid structure 18 from the electrode 12). To that end, a non-limiting process given by way illustration only includes: coating a stack of the electrode 12 and the first film layer 14 stack with resist 26 (FIG. 8A); exposing the resist 26 (FIG. 8B); developing the resist 26 (FIG. 8C); etching the first film layer 14 (FIG. 8D); removing the resist 26 (FIG. 8E); and depositing the second film layer 16 (FIG. 8F).

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to,"

"related to," or other past-tense adjectives are generally not intended to exclude such variants, unless context dictates otherwise.

Various example embodiments of the disclosed subject matter can be described in view of the following clauses:

1. A vacuum electronics device comprising:
an electrode;
a first film layer disposed on the electrode about a periphery of the electrode; and
a second film layer disposed on the first film layer, the second film layer including a plurality of electrically conductive grid lines patterned therein that are supported only at the periphery of the electrode by the first film layer.
2. The device of clause 1, wherein gap distance between the electrode and portions of the plurality of grid lines that are not supported by the first film layer are variable responsive to application of an electrostatic force between the electrode and the plurality of grid lines.
3. The device of clause 1, wherein the electrode includes a material chosen from chromium, platinum, nickel, tungsten, molybdenum, niobium, and tantalum.
4. The device of clause 1, wherein the first film layer includes a material chosen from a dielectric, an electrical insulator, a ceramic, silicon oxide, silicon nitride, and aluminum oxide.
5. The device of clause 1, wherein the second film layer includes an electrical conductor.
6. The device of clause 5, wherein the electrical conductor includes a material chosen from chromium, platinum, nickel, tungsten, molybdenum, niobium, and tantalum.
7. The device of clause 5, wherein the electrical conductor is disposed within an electrical insulator.
8. The device of clause 1, wherein the plurality of grid lines include a geometry chosen from a substantially straight line, a curved line, a circle array, a triangle array, and a hexagon array.
9. The device of clause 1, further comprising: a layer of electrically conductive material disposed on the second film layer and the electrode.
10. The device of clause 1, wherein the electrode is etched between the plurality of grid lines.
11. The device of clause 1, wherein a gap distance between the electrode and the plurality of grid lines is varied.
12. A method of fabricating a vacuum electronics device, the method comprising:
providing an electrically conductive substrate;
depositing a first film layer on the substrate;
depositing a second film layer on the first film layer;
defining a plurality of grid lines in the second layer; and
selectively removing a portion of the first film layer such that the first film layer supports the plurality of grid lines only at a periphery of the substrate.
13. The method of clause 12, further comprising: depositing an electrically conductive film layer on the plurality of grid lines.
14. The method of clause 13, further comprising: depositing an electrically conductive film layer on the substrate.
15. The method of clause 12, wherein depositing a first film layer on the substrate and depositing a second film layer on the first film layer are performed via a process chosen from chemical vapor deposition, physical vapor deposition, electroplating, evaporation, sputtering, and atomic layer deposition.
16. The method of clause 12, wherein defining a plurality of grid lines in the second layer is performed via a process chosen from lithography, photolithography, electron-beam lithography, block co-polymer lithography, nanosphere lithography, nanoimprint lithography, self-aligned double patterning, and double patterning.
17. The method of clause 12, wherein selectively removing a portion of the first film layer such that the first film layer supports the plurality of grid lines only at a periphery of the substrate is performed via a process chosen from wet etching, dry etching, plasma etching, ion bombardment, reactive-ion etching, isotropic etching, and anisotropic etching.
18. The method of clause 12, further comprising selectively etching the second film layer to a geometry chosen from a substantially straight line, a curved line, a circle array, a triangle array, and a hexagon array.
19. A method of fabricating a vacuum electronics device, the method comprising:
coating a stack of an electrode and a first film layer disposed on the electrode with resist;
exposing the resist;
developing the resist;
etching the first film layer;
removing the resist; and
depositing the second film layer.
20. The method of clause 19, wherein etching the first film layer is performed via a process chosen from wet etching, dry etching, plasma etching, ion bombardment, reactive-ion etching, isotropic etching, and anisotropic etching.

While a number of illustrative embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. A vacuum electronics device comprising:
an electrode;
a first film layer disposed on a periphery of the electrode and defining a plurality of grid supports on the electrode in between the periphery of the electrode, each of the plurality of grid supports having a first width; and
a second film layer disposed on the first film layer, the second film layer defining:
a first plurality of electrically conductive grid lines patterned therein that are supported only at the periphery of the electrode by the first film layer; and
a second plurality of electrically conductive grid lines patterned therein that are supported on the plurality of grid supports, each of the second plurality of electrically conductive grid lines having a second width that is wider than the first width.

2. The device of claim 1, wherein a gap distance between the electrode and portions of the first plurality of grid lines that are not supported by the first film layer are variable responsive to application of an electrostatic force between the electrode and the first plurality of grid lines.

3. The device of claim 1, wherein the electrode includes a material chosen from chromium, platinum, nickel, tungsten, molybdenum, niobium, and tantalum.

4. The device of claim 1, wherein the first film layer includes a material chosen from a dielectric, an electrical insulator, a ceramic, silicon oxide, silicon nitride, and aluminum oxide.

5. The device of claim 1, wherein the second film layer includes an electrical conductor.

6. The device of claim 5, wherein the electrical conductor includes a material chosen from chromium, platinum, nickel, tungsten, molybdenum, niobium, and tantalum.

7. The device of claim 5, wherein the electrical conductor is disposed within an electrical insulator.

8. The device of claim 1, wherein the first and second pluralities of grid lines include a geometry chosen from a substantially straight line, a curved line, a circle array, a triangle array, and a hexagon array.

9. The device of claim 1, further comprising:

a layer of electrically conductive material disposed on the second film layer and the electrode.

10. The device of claim 1, wherein a gap distance between the electrode and the first plurality of grid lines is varied.

11. A vacuum electronics device comprising:

an electrode patterned to define a periphery thereof;

a first film layer disposed on the periphery of the electrode, a surface of the electrode being disposed below the first film layer in between the periphery of the electrode; and a second film layer disposed on the first film layer, the second film layer defining a plurality of electrically conductive grid lines patterned therein that are supported only at the periphery of the electrode by the first film layer.

12. The device of claim 11, wherein a gap distance between the electrode and portions of the plurality of grid lines that are not supported by the first film layer are variable responsive to application of an electrostatic force between the electrode and the first plurality of grid lines.

13. The device of claim 11, wherein the electrode includes a material chosen from chromium, platinum, nickel, tungsten, molybdenum, niobium, and tantalum.

14. The device of claim 11, wherein the first film layer includes a material chosen from a dielectric, an electrical insulator, a ceramic, silicon oxide, silicon nitride, and aluminum oxide.

15. The device of claim 11, wherein the second film layer includes an electrical conductor.

16. The device of claim 15, wherein the electrical conductor includes a material chosen from chromium, platinum, nickel, tungsten, molybdenum, niobium, and tantalum.

17. The device of claim 15, wherein the electrical conductor is disposed within an electrical insulator.

18. The device of claim 11, wherein the plurality of grid lines include a geometry chosen from a substantially straight line, a curved line, a circle array, a triangle array, and a hexagon array.

19. The device of claim 11, further comprising:

a layer of electrically conductive material disposed on the second film layer and the electrode.

20. The device of claim 11, wherein a gap distance between the electrode and the plurality of grid lines is varied.

21. A vacuum electronics device comprising:

an electrode patterned to define a periphery thereof;

a first film layer disposed on the periphery of the electrode and defining a plurality of grid supports on the electrode in between the periphery of the electrode, each of the plurality of grid supports having a first width, a surface of the electrode being disposed below the first film layer between the periphery of the electrode and the grid supports and between the grid supports; and a second film layer disposed on the first film layer, the second film layer defining:

a first plurality of electrically conductive grid lines patterned therein that are supported only at the periphery of the electrode by the first film layer; and a second plurality of electrically conductive grid lines patterned therein that are supported on the plurality of grid supports, each of the second plurality of electrically conductive grid lines having a second width that is wider than the first width.

22. The device of claim 21, wherein a gap distance between the electrode and portions of the first plurality of grid lines that are not supported by the first film layer are variable responsive to application of an electrostatic force between the electrode and the first plurality of grid lines.

23. The device of claim 21, wherein the electrode includes a material chosen from chromium, platinum, nickel, tungsten, molybdenum, niobium, and tantalum.

24. The device of claim 21, wherein the first film layer includes a material chosen from a dielectric, an electrical insulator, a ceramic, silicon oxide, silicon nitride, and aluminum oxide.

25. The device of claim 21, wherein the second film layer includes an electrical conductor.

26. The device of claim 25, wherein the electrical conductor includes a material chosen from chromium, platinum, nickel, tungsten, molybdenum, niobium, and tantalum.

27. The device of claim 25, wherein the electrical conductor is disposed within an electrical insulator.

28. The device of claim 21, wherein the first and second pluralities of grid lines include a geometry chosen from a substantially straight line, a curved line, a circle array, a triangle array, and a hexagon array.

29. The device of claim 21, further comprising:

a layer of electrically conductive material disposed on the second film layer and the electrode.

30. The device of claim 21, wherein a gap distance between the electrode and the first plurality of grid lines is varied.

* * * * *